United States Patent [19]

Loix

[11] 4,256,200

[45] Mar. 17, 1981

[54] DOUBLE EXTENDIBLE OR SUPPORT LADDER

[76] Inventor: Gilbert Loix, Chaussee Brunehault 22, 4462 Juprelle-Wihogne, Belgium

[21] Appl. No.: 40,724

[22] Filed: May 21, 1979

[30] Foreign Application Priority Data

May 23, 1978 [BE] Belgium ..... 867361

[51] Int. Cl.[3] ..... E06C 1/383

[52] U.S. Cl. ..... 182/22; 182/162

[58] Field of Search ..... 182/159, 160, 161, 162, 182/22

[56] References Cited

U.S. PATENT DOCUMENTS

| | | | |
|---|---|---|---|
| 193,081 | 7/1877 | Gay | 182/162 |
| 798,388 | 8/1905 | Bodendieck | 182/162 |
| 860,065 | 7/1907 | Scott | 182/22 |
| 958,732 | 5/1910 | Dennis | 182/162 |
| 4,016,954 | 4/1977 | Hickman | 182/162 |
| 4,027,741 | 6/1977 | Derrick | 182/22 |

*Primary Examiner*—Reinaldo P. Machado

*Attorney, Agent, or Firm*—Robert E. Burns; Emmanuel J. Lobato; Bruce L. Adams

[57] ABSTRACT

A step ladder with rungs which can be retracted and transformed, without dismantling, into a folded ladder and an extension ladder.

13 Claims, 20 Drawing Figures

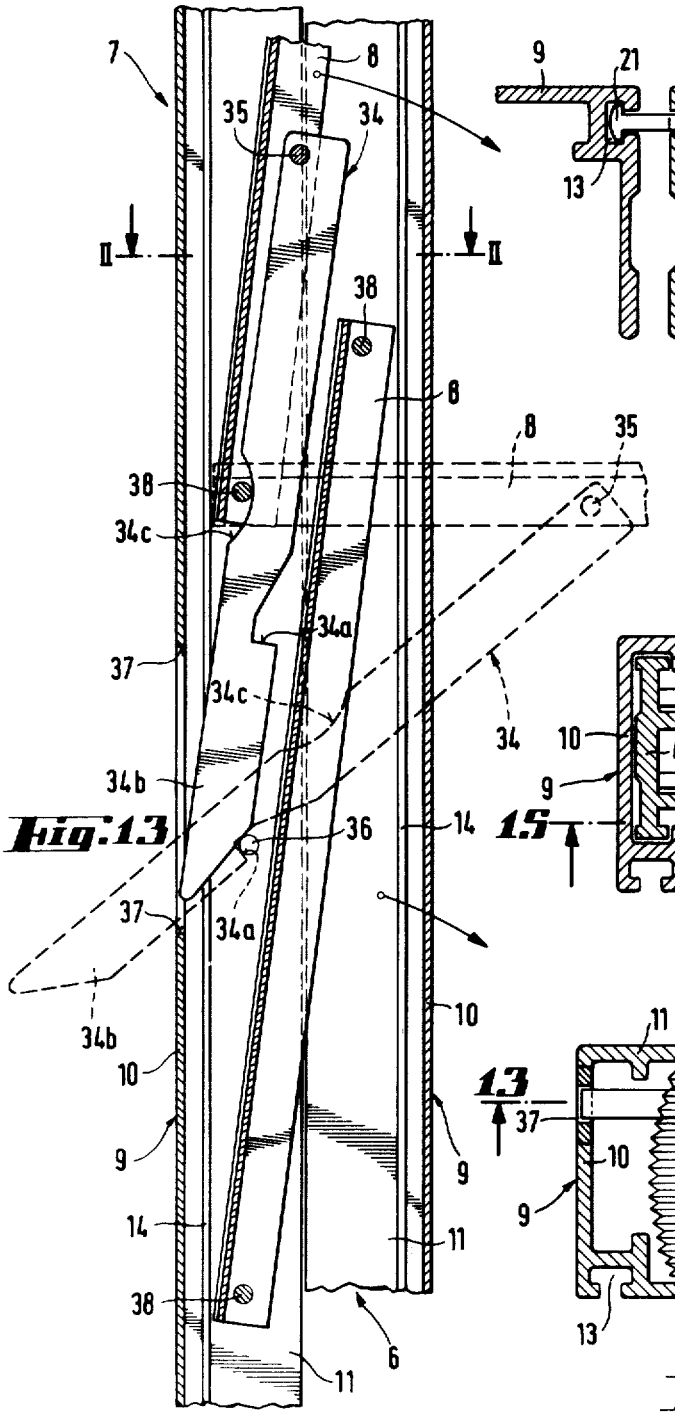
Fig. 13
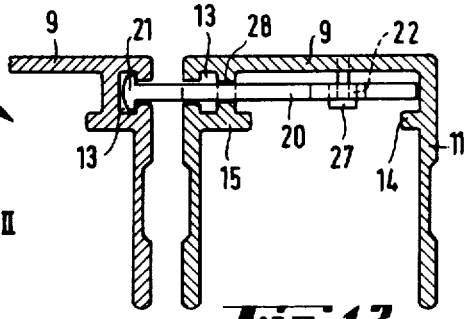
Fig. 12
Fig. 16
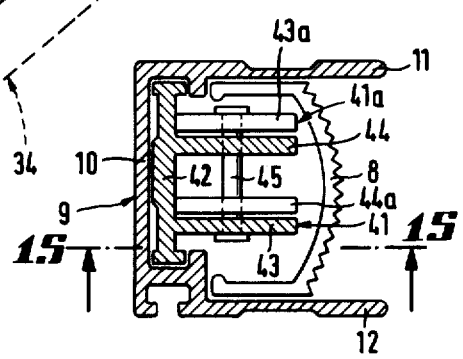
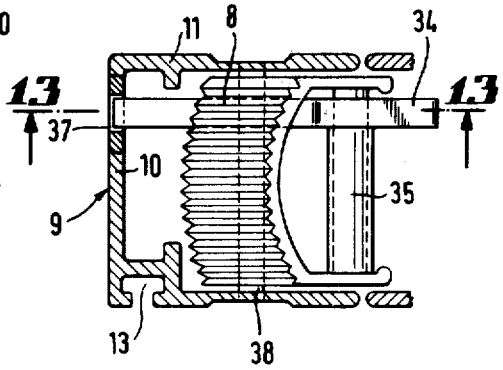
Fig. 14

DOUBLE EXTENDIBLE OR SUPPORT LADDER

BACKGROUND OF THE INVENTION

This invention concerns a double ladder with rungs which can be retracted and transformed, without dismantling, into a support ladder or a flat extendible ladder.

Single ladders with retractable rungs are already known, i.e. ladders with uprights which fold back against one another and rungs placed more or less vertically; or double ladders with an initial component which slides onto the other so as to make an extendible ladder. In some cases, this initial component can be separated from the other to be used as a support component and fixed to the other component to make a double support ladder.

SUMMARY OF THE INVENTION

The double or step ladder with rungs which can be retracted and transformed, without dismantling, into a support ladder or a flat extendible ladder, according to the invention, is characterized in that each part is formed by two straight uprights with an identical section, in the general shape of a straight open U/channel bar, facing one another and between which identical rungs are fixed by a pivoting axis; these rungs have a section in the general shape of an open U/channel bar, with dimensions which are less than the section of the uprights; at least one of the two parts comprises a device for holding the ladder open, a fixed device which is placed under a rung when the ladder is closed. On the lateral side forming a base, the section of the uprights comprises a guide groove in the general shape of a T, into which is slipped, in the two uprights of one part of the ladder, the head in the general shape of a T of a flat interlocking piece of the two parts of the ladder; this interlocing piece is fixed in a restricted pivoting position close to the upper extremity of the other two uprights of the ladder, so that one of the two parts of the ladder may, simultaneously, slide parallel to the other and/or pivot with regard to the other; in the uprights of one part of the ladder are fixed, parallel to the central part, at least one plate terminating in a noise piece in the form of a hook, emerging from these uprights, a hook piece which is placed in a series of slots provided at different eye-level heights in the uprights of the other part of the ladder uprights; these hooks are for the purpose of holding one part of the ladder with respect to the other, when it is being used as a flat extendible ladder.

By way of preference, each of the two uprights of the part of the ladder intended to serve as a support, terminates below the last lower rung in a section length linked to the upper part by a device with restricted pivoting towards the exterior, so that it gives a larger bearing to the support of the ladder which may be necessary and even obligatory in order to respect the legal safety standards in some countries.

Except in the case of force, a system of ball clamps, for example, prevents these lengths from opening out towards a position of separation vis-a-vis the rest of the uprights and being held in a separated position.

Furthermore, in accordance with the invention, the double ladder is remarkable because of the fact that, in a storage, stocking and transport position, it is presented in the form of a chest, with a section, without any component parts emerging from it, in the shape of a rectangle verging on a square, one side of which is equal to double one lateral side of an upright, and the other side is equal to double the central side of an upright plus a slight spacing provided for between the parts of the ladder.

BRIEF DESCRIPTION OF THE DRAWINGS

In order to understand the invention better and to bring to light the characteristics and advantages, it has now been described with respect to the attached diagram which represents, by way of example and without limitations, in FIG. 1, diagram of a side view of the double ladder in the stocking position;

FIG. 12, partial sectional view from above in accordance with line I/I of FIG. 11;

FIG. 13, partial longitudinal section view into the uprights of one part of the double ladder showing the component for holding the double ladder open, continuous lines with the ladder in a closed position, broken lines when the ladder is fixed in an open position;

FIG. 14, partial sectional view from above as per line II/II of FIG. 13, simply with the ladder in the closed position;

FIG. 16, partial sectional view from above as per line III/III of FIG. 15;

DESCRIPTION OF THE PREFERRED EMBODIMENTS

Figure 1:
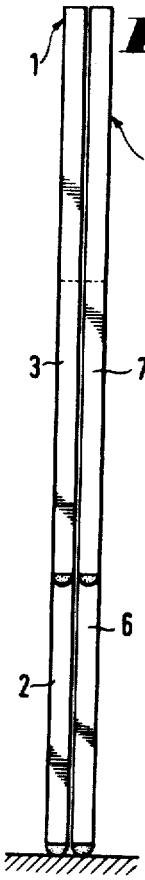

Referring to FIGS. 1 to 5, it can be seen that the double ladder is formed by a first part 1, comprising the uprights 2, 3 and rungs 4; of a second part 5, comprising uprights 6, 7 and rungs 8.

As is visible in these FIGS. 1 to 5, the double ladder 1, 5 can be used and presented in various ways; FIG. 1, fully folded, on the one hand, with part 1 against part 5 but, moreover, with upright 3 pulled down onto upright 2 of the same part 1; and upright 7 against upright 6 of the same part 5 of the double ladder, as the rungs 4 and 8 respectively, of the two parts 1, 5 are connected by pivoting axes (not illustrated) at each end to the uprights 2,3 and 6,7.

However, it must be noted that, if the uprights 3 and 7 are drawn against the other uprights, 2 and 6 respectively, the uprights 3 and 7 will project past the others in length by the distance between the two pivoting axes of a rung.

In FIG. 1, the double ladder 1, 5 is therefore closed, in a storage and transport position; it is presented in the form of a long chest rectangular in shape verging on a square, formed by the four identical uprights 2,3,6,7.

Figure 2:
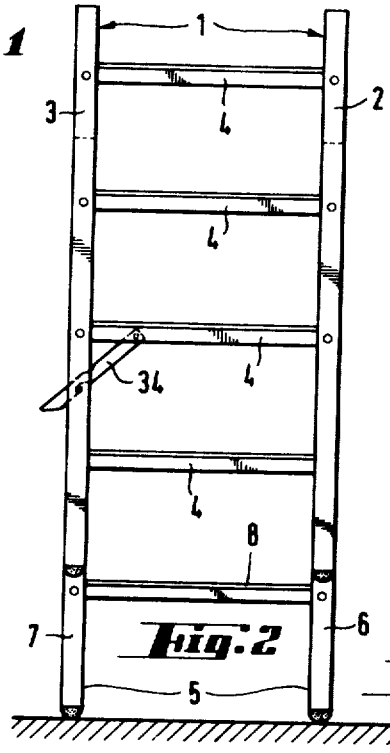
FIG. 2, diagram of a frontal view of the double ladder used as an extendible ladder, one part raised by one rung vis-a-vis the other.
Figure 3:
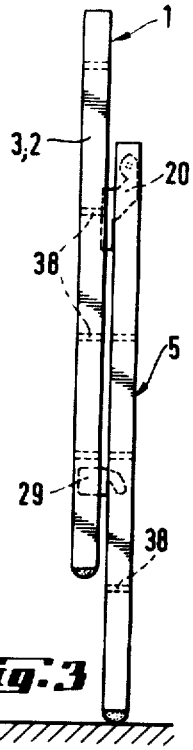
FIG. 3, a side sectional view at the level of the interlocking component of the two parts of the double ladder in the same position as in FIG. 2.
Figure 4:
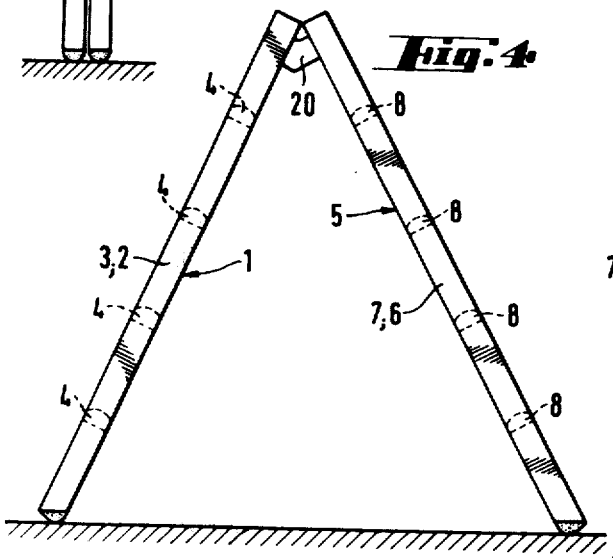
FIG. 4, diagram of a side view of the double ladder used as a support ladder.

In FIGS. 2 and 3, the double ladder 1, 5 is represented in use as the extendible ladder, part 1 being raised up by one rung vis-a-vis part 5. In FIG. 4, the double ladder 1, 5 is represented in use as the support ladder, part 5 acting as a support for part 1; in order to give a perfect bearing to this support part 5, uprights 6,7 have separable lengths 6*a*,7*a* (FIG. 5) at their lower parts.

Figure 6:
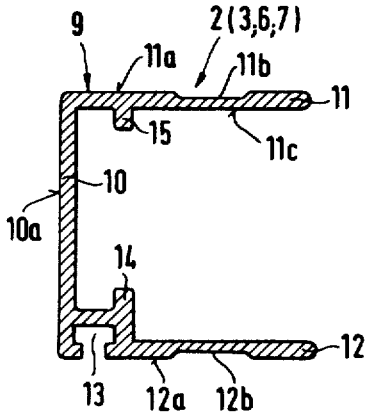
FIG. 6, sectional view into an upright showing its section.

In order to effect a double ladder 1, 5 which can have the various usages indicated above, whilst maintaining the same safety standards as ladders of a known type, and being presented in the form of a chest square in shape and without any projection, extruded section metallic components, preferably aluminum, are used. In FIG. 6, one can see section 9 provided to effect the four uprights 2,3; 6,7, which has the following characteristics: it has the shape of a straight U/channel bar, of which the external face of the central part 10 is straight and will form the external lateral face of each upright 2,3, 6,7; and of which the external side 11*a* of one of the two lateral parts 11 is straight and will form the free side of the uprights 2, 3, 6, 7; and of which the other lateral part 12 acts as a base (i.e. the side of an upright of one part of the double ladder facing the side of the upright of the other part) to the external face 12*a* equipped with a guide groove 13 in the general shape of a T. Furthermore, internally, the two lateral parts 11,12 are provided opposite with a support wing 14, 15 respectively, perpendicular to them, i.e. parallel to the central part 10.

Figure 7:
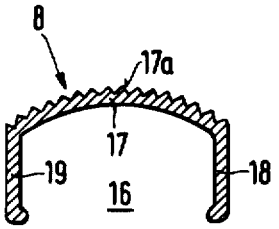
FIG. 7, a sectional view into a rung showing its section.

In FIG. 7, one can see section 16 provided in order to effect rungs 4,8, which has the general shape of a U/-channel bar, of which the central part 17, at least the external face 17*a*, is preferably slightly convex and equipped with adhesion ribs, whilst the lateral parts 18, 19 are straight.

Figure 8:
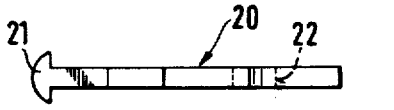
FIG. 8, view from above of the interlocking component of the two parts of the ladder.
Figure 9:
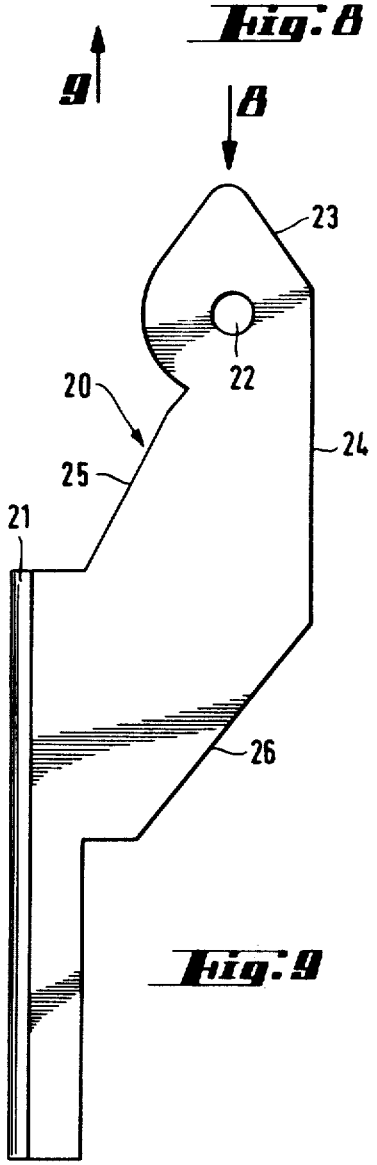
FIG. 9, lateral view of the same component as in FIG. 8.

In FIGS. 8 and 9, one can see the shape of the interlocking piece 20 (FIG. 3) between two parts 1 and 5 of the double ladder. It is a question of an elongated piece (FIG. 8) which is flat except for a head 21 in the general shape of a T and of a size in keeping with the guide grove 13 of the section 9 used for the uprights 2,3 6,7. This interlocking piece 20 contains an opening 22 (FIG. 2) for the passage of a pivoting axis and is cut so as to provide on the cut edge various support faces and others 23, 24, 25, 26, restricting its pivoting.

Figure 11:
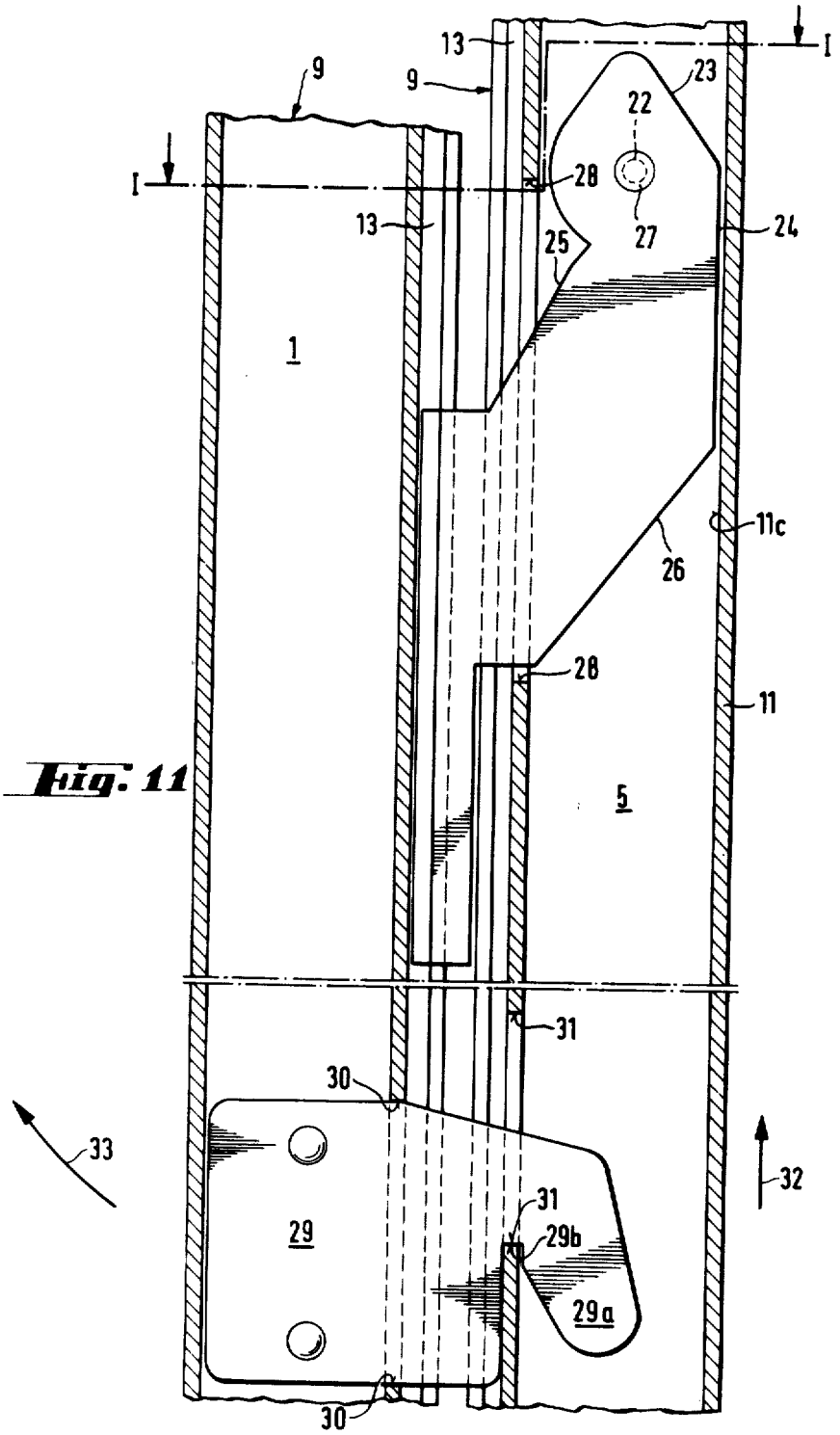
FIG. 11, partial longitudinal section view into the uprights of the double ladder at the level of the interlocking component and at the level of a component for holding one part of the double ladder with respect to the other.

Referring to FIGS. 11 and 12, the role of this interlocking piece 20 can be seen; the head of this piece 21 is, on the one hand, slid into the groove 13 of a section 9 used as upright 2, 3 of the part 1 of the double ladder and, on the other hand, held inside a section 9, used as upright 6,7 of the part 5 of the double ladder, by a pivoting axis 27 passing through the opening 22 (FIG. 12) which is to be found close to the upper end of these uprights 6,7. As is visible in FIG. 11, a slot 28 is provided in the groove 13 of an upright 6/7 of part 5 of the double ladder to insert the piece 20; the slot 28 is long enough so as not to prevent the desired pivoting of piece 20 which, as is visible in FIG. 11, rests by its cut edge 24 on the internal face 11*c* of the side 11 of the section 9 acting as upright 6/7 of part 5 of the double ladder used as an extendable ladder, whilst, on the one hand, its cut edge 25 will be against the upper edge of slit 28 and, on the other hand, its cut edge we will rest against the internal face 11*b* of the side 11 of the section 9, acting as upright 6, 7 of the part 5 of the double ladder, when it is used as a support ladder (FIG. 4), thus restricting the pivoting and therefore the spacing angle.

Referring to the lower part of FIG. 11, one of the plates 29 can be seen (also illustrated in FIG. 3) fixed, for example by rivets in the section 9 used as upright 2, 3 of part 1 of the double ladder and of which a part 29*a*, a nose piece in the form of a hook, emerges from this part 1. This plate 29 is inserted through a slot 30 provided in the bottom of the groove 13 of the section 9 used as upright 2, 3 of part 1 of the double ladder. This plate 29 is therefore placed like the interlocking piece behind the support wings 14, 15 of the section 9. In order to allow the hook part 29*a* of these plates, to settle on the upright 6, 7 opposite part 5 of the ladder, the latter comprises a certain No. of slots 31 provided at specific distances along the bottom of the groove 13 of the section 9 used as upright 6,7.

In order to prevent the swaying and to damp the extendible part 1 of the double ladder with respect to part 5, the plate 29 also comprises a straight notch turned towards the bottom 29*b*, the width of which is only slightly greater than the side of the section 9 which it passes over, as is visible in FIG. 11. The height of the slot 31 shall be sufficient to allow notch 29*b* to be released and the nose hook 29*a* to be removed, an operation which is carried out easily firstly by lifting part 1 of the ladder upwards (arrows 32) in order to release the notch 29*b*, the head 21 of the interlocking piece 20 held by part 5 of the double ladder, sliding into the groove 13 of part 1 of the double ladder, and then, simultaneously, lifting (arrow 32) and moving part 1 of the double ladder to one side (arrow 33) with respect to part 5, the interlocking piece 20 pivoting in part 5 of the double ladder. Conversely, when part 1 of the double ladder is raised upon usage as an extendible ladder, and therefore in order to make part 5 project beyond part 1, the hook parts of 29 a of the plates 29 must be released from the slots 31 and part 1 seperated from part 5 of the double ladder (arrow 33), except at the level of the interlocking piece 20. The head 1 can then be slid perfectly upwards with respect to part 5, the head 21 of the interlocking piece held by part 5 sliding into the groove of part 1 of the double ladder. Moreover, the external end of the nose hook 29*a* can slide into and against the bottom of the groove 13 of part 5, until it meets a slot 31, higher than the previous one, into which it is inserted, unless part 1 is held separated, which allows the movement of this part 1 to continue upwards with regard to part 5. As soon as the nose hook 29*a* has been fully inserted into a slot 31, it will obviously redescend until the notch 29*b* draws onto the edge of slot 31; this carries along the plate 29 and therefore part 1 too, downwards slightly. Preferably, at least one plate 29 is provided fixed to each of the uprights 2, 3 of part 1 of the double ladder, but two per upright may be provided; in this case, at distances of a height equal to the space between the rungs 4 or 8 and therefore at least from the slots of 31 to each of the uprights 6,7 of the part 5; slots 31 at distances of this same height, on each upright.

If the replacement of a plate 29 (or two plates) is planned at each upright of part 1 of the double ladder at the bottom of these uprights (e.g. below the last rung 4) and, in the case of two plates, the second below the second to last rung 4; on the other hand, slot 31 are provided at different places along each upright 6, 7 of part 5 (e.g., below each rung 8) so as to be able to fix part 1, one, two three, . . . rungs higher than part 5. Naturally, both the plates 29 and the slots 31 shall be arranged in such a way that the rungs of the lengths of the two parts 1 and 5 facing, are also facing, i.e., horizontally parallel.

It must be noted, as is visible in FIG. 11, that the uprights 2,3 of part 1 do not come against the uprights 6,7 of part 5, but are held slightly away from the latter so as not to prevent the pivoting movement (arrow 33) of part 1 with respect to part 5, which, however, shall only be possible if the interlocking piece 20 is placed close to the end of the uprights 6,7 of part 5 and, naturally, it shall always be part 1 alone which can be raised up again with respect to part 5 and not the reverse.

Referring to FIGS. 13 and 14, the method of holding the double ladder in the open position is now described (FIG. 2), i.e. the device for holding the rungs 4 and 8 horizontally and the uprights 3 and 7 separated from the uprights 2 and 6; this holding device is a plate 34 held by a free pivoting axis 35 beneath a rung 8 of part 5 of the double ladder, preferably a rung 8 is at a height which is easily reached by hand (i.e. for example, between one meter and one meter fifty). This plate 34 comprises a slash forming a holding notch 34*a* and terminates in a pointed triangular part 34*b*. The holding notch 34*a* is intended to clamp the plate 34 on a fixed axis 36 held by the lateral sides 11,12 of the section 9 used as upright 7. The length of the plate 34 is such that its triangular part 34*b* has to be on the other side of the fixed axis 36 even when the ladder is in a closed position (continuous lines FIG. 13) the fixed axis 36 forcing the end of 34*b* of the plate to be passed through an opening 37 provided in the central part 10 of the section 9 used as upright 7 when the ladder is opened i.e., bringing the rungs 8 back to a horizontal position (dotted lines, FIG. 13) so that one part of the plate, preferably higher than part 34*b*, emerges from the upright 7. It is this part emerging from the upright 7 that shall be lifted in order to release the plate 34 from the fixed axis 36 and in order to be able to reclose the double ladder.

Furthermore, as is visible in FIG. 13 (continuous lines), so that the pivoting axis 38 of the rung 8 of the upright 7 does not prevent the reerecting of the plate 34; the plate is provided with a rounded slit 34*c*, but it must be noted that the plate 34 in a re-erected position (FIG. 13, continuous lines) is thus held perfectly, on one side by the axis 38 and on the other side, by the fixed axis 36 so, that when the ladder is in a closed position, the plate 34 cannot emerge from the upright 7.

On account of the interlocking pieces 20, it is easily understood that by clamping part 5 of the double ladder in an open position the other part 1 too shall automatically be clamped in the open position, but, however, a plate 34 can be provided both on part 1 and part 5 of the ladder.

Figure 5:
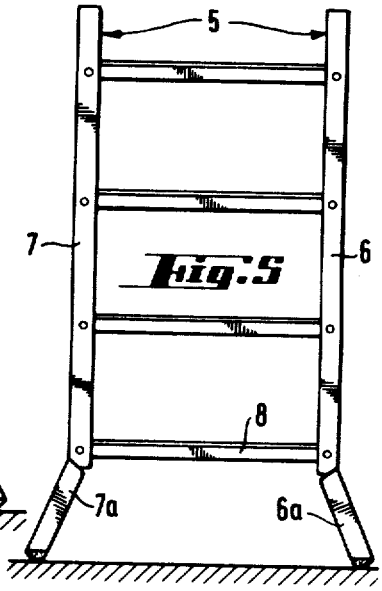
FIG. 5, diagram of a frontal view of a possible preferential part of the support component of the double ladder.
Figure 10:
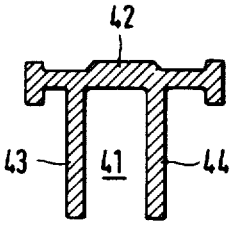
FIG. 10, sectional view showing the section of the connection component of a separable length of an upright of the support component of the double ladder.
Figure 15:
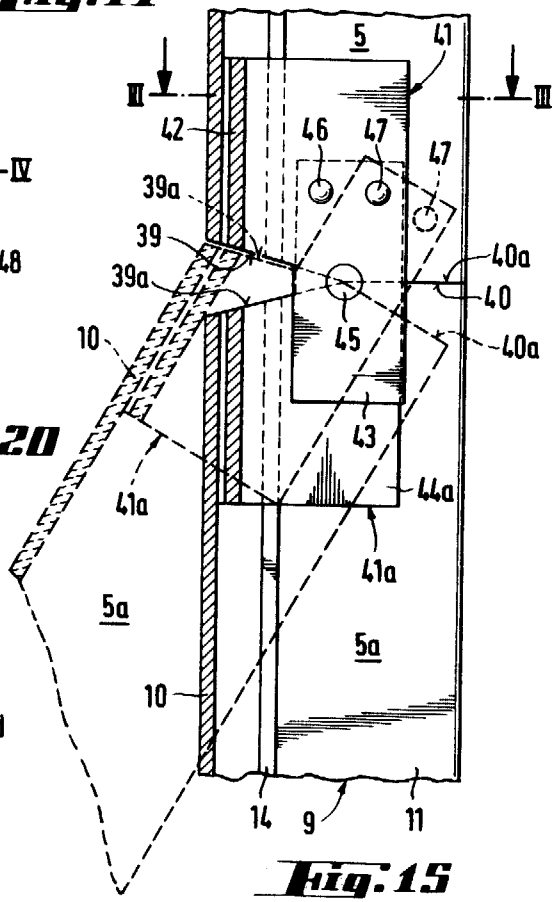
FIG. 15, longitudinal section view into an upright of the part of the ladder comprising a separable length.

Referring to FIGS. 15 and 16, the means provided in order to render the lengths 6*a* and 7*a* (part 5*a*) of part 5 of the double ladder separable is now described (FIG. 5). Outside each of the uprights 6 and 7, a length 6*a* and 7*a*, beneath the last rung 8, is separated horizontally, and both the end of the main part 5 and the end of the lower part 5*a* are partially cut in a bevelled fashion so as to present a partially inclined surface, 39 and 39*a* respectively, surfaces which act respectively as support surfaces or bases when the lengths of the part 5*a* are moved away with respect to the uprights of part 5. The straight surfaces 40 and 40*a* shall, on the other hand, normally act as a support when part 5*a* is held upright with respect to part 5. In order to link parts 5 and 5*a*, another section 41 (FIG. 10) is slid into the section 9 used to effect these parts; this section 41 has the general shape of an asymmetrical portico, the basic characteristics of which are a central part 42 which will rest against the part 10 of the section 9 used for the uprights and upright lengths of part 5, 5*a* of the ladder and two perpendicular wings 43 and 44 which are arranged asymmetrically with respect to the central part, so that when using a section length 41 in the upright of one of the two parts 5, 5*a* and another identical section length 41 reversed in the other, the wings 43 and 44 of the length 41 are situated on another plane parallel to the wings 43*a* and 44*a* of the length 41*a* (FIG. 16) and, as visible in FIG. 15 these section lengths 41 and 41*a* also being cut in a bevelled fashion; like parts 5 and 5*a*, with the exception of a part of their wings 43, 44 and 43*a*, 44*a*, respectively which are on the contrary extended, they can face one another in order to insert a pivoting axis 45 (FIG. 16). As visible in FIG. 15, the pivoting of the lengths of uprights 6*a* and 7*a* of part 5*a* with respect to the uprights 6, 7 of part 5, is restricted between the support surfaces 39, 39*a* and 40, 40*a*. In order to hold the lengths of the uprights 6*a*, 7*a* of part 5*a* in the two positions, separated or in the extension of the uprights 6, 7 of part 5, a ball clamp system is provided equipped with a pressure spring (not illustrated) and which can successfully place itself partially either in cavity 46 or cavity 47 of a wing respectively, when the parts 5*a* are extended or separated with respect to parts 5 of the double ladder.

Figure 17:
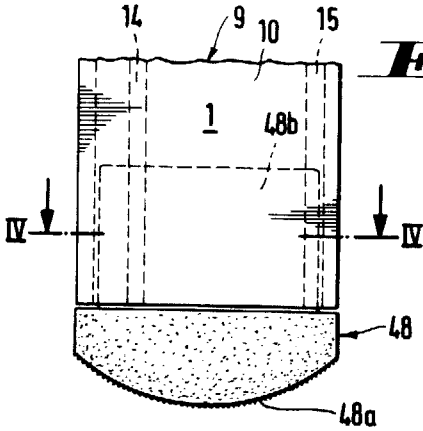
FIG. 17, outline lateral view of the end of an upright and a terminal, lower foot.
Figure 18:
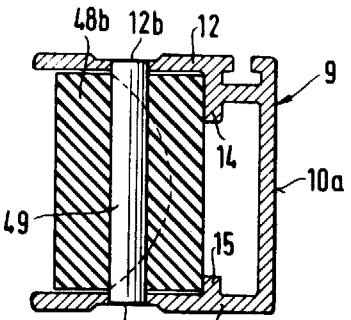
FIG. 18, sectional view through the bottom in accordance with line IV/IV of FIG. 17.
Figure 19:
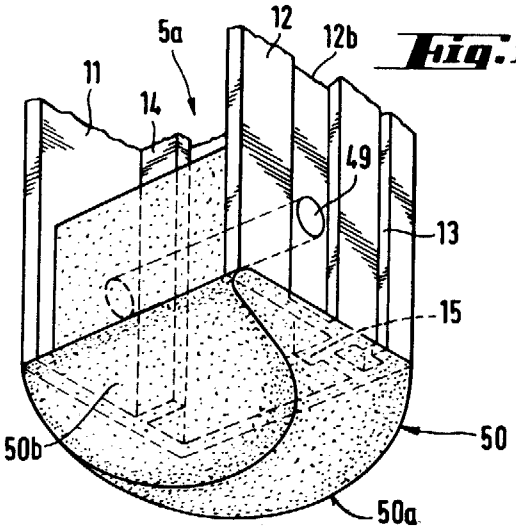
FIG. 19, partial side view in perspective of a length of one separable upright and its terminal.

FIGS. 17 and 18 show the terminal feet 48, components in rubber presenting externally, towards the bottom, a convex curve 48*a* and adhesion lines, surmounted firstly by a part 48*b* with the general external dimensions of the section 9 used for the uprights 2 and 3 of part 1 of the double ladder; then, by a part with the general internal dimensions of the section 9 but limited to the part on this side of the wings 14, 15 (FIG. 18); a fixing axis 49 is provided in order to hold these terminals 48. For the lengths 6*a*, 7*a* of the part 5*a*, separable from the uprights 6, 7 of part 5 of the double ladder, terminal feet 50 have been planned presenting a double bearing towards the bottom 50*a* and 50*b*; the part 50*c* has the same bevelled slope as the bevelled cut 39 of part 5 or of part 5*a* of the separable length (FIG. 15).

Furthermore, these terminal feet 50 have the same characteristics as the terminals 48, in other words part 50*a* presents a convex curve, part of the terminal 50*c* re-enters into the section 9 used as upright 6*a*, 7*a* of part 5*a*; the terminals 50 shall also be held by a fixing axis 49.

Figure 20:
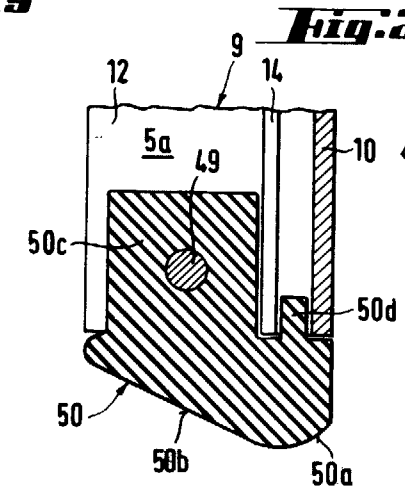
FIG. 20, longitudinal section of the same view as in FIG. 19.

As is visible in FIG. 20, in addition a tongue 50*d* is provided which comes behind the wings 14, 15; this may also be the case for the terminals 48. If it is planned to place terminals 48 and 50 at the feet of the two parts 2 and 5 of this double ladder it can also be planned to place terminals 48 at the head of the two parts 2 and 5 of this double ladder. In the event that part 5 of the double ladder comprises parts 5*a* of separable lengths (variant of execution), the height of this part 5*a* shall always be slightly lower than the distance from the ground and the first rung 8; in this event, the plates 29 can no longer be arranged on any level of the uprights 2, 3 of part 1 of the ladder; in effect, the slots 31 shall not be able to be used at the level of the lengths of section 41 and 41*a* and either it is planned to place the plates 29 beyond the first rung 4 of part 1 of the double ladder or, for example, half way between the ground and the first rung 4, i.e. in principle, half way between two rungs 4, . . . but it is not essential for this to be so.

The double ladder described is therefore remarkable by the double usage possibility which it offers,—an extended ladder or support ladder; and, furthermore, by the fact that it can be arranged, in the closed position, so as to form no more than a simple chest, which is particularly useful for its storage or its transport. Given that no components protrude from this chest, the stocking of a consignment of double laddes shall not present any problems; in fact if, in order to hold the pivoting axes 38 of the rungs 4 and 8, the fixing axes 49 of the terminals 48 and 50, of the fixed axis 36 of the plate 34, one may be led to provide rivets or other devices (not illustrated) to be placed outside the sections 9 used for the uprights of the two parts 1 and 5 of the double ladder; at each of the external surfaces 11*a* 12*a* of the lateral sides 11 and 12 respectively of the section 9, a contraction band 11*b* and 12*b* respectively (FIG. 6) is provided so that the external end of the head of the rivets (not illustrated) shall not project beyond the general plane of the external surface, 11*a* and 12*a* respectively, of the lateral side 11 and 12 of the section 9.

Furthermore, both the interlocking parts 20 and the hook plates 29 and the section lengths 41 and 41*a* shall be fixed by the inside in the section 9 used as upright of the double ladder.

Naturally, the invention is not limited to the form of production described and illustrated, and in particular the structural sections 9, 16 and 41 as the pieces 20, 29 and 34 could present differences in dimensions or proportions by themselves or reciprocally.

As already indicated, if it appears to be necessary to provide an interlocking piece 20 between the upright forcing the two parts 1 and 5 of the double ladder, it is not normally necessary to provide more than one pair of hooks 29 in the uprights of the extendible part 1 of the double ladder; but, on the other hand, it may be desirable to provide a plate 34 on each of the two parts 1 and 5 of the double ladder.

Furthermore, if, throughout the description, it has been indicated, that for one of the two parts of the double ladder it was a question of a support part 5, it is however possible conversely, to consider the other part 1 as being the support component of part 5 and to provide it with a separable part and as logically, in any double support ladder, it can be mounted on one side, therefore one part, or on the other, therefore on the other part. On the other hand, the same shall not apply to the two parts of the double ladder used as an extendible ladder, because, by way of necessity, one of the two parts is planned and produced so as to rise with respect to the other and, by way of necessity, the part intended to rise, shall comprise hooks 29 whilst the interlocking pieces 20 shall be fixed onto the other part.

Further constructive details could have been given in the description such as, for example, the utilisation of washers at the various pivoting axes; furthermore, it could also be possible to provide another clamping device for the separable parts 6*a* and 7*a* of the uprights 6 and 7 of part 5 and replace the ball clamp by a sector comprising a concave spring blade set either in the cavity 46 or in the cavity 47, the latter being adapted, in this case, to this system.

It is quite certain that it would not be outside the framework of the invention to provide simple and usual means of clamping or assembly such as, for example, pins, etc. but this would be contrary to the spirit of the invention which intends to produce a ladder with several usages, easy to use, whilst having great safety by the self clamping methods planned and furthermore, which does not present any external component to the structural sections 9 constituting the uprights of the double ladder.

I claim:

1. A double ladder with rungs which can be folded away-retracted and transformed, without dismantling, into a support ladder or a flat extendible ladder characterised in that each part (1,5) is formed by two straight uprights (2,3 and 6,7) having an identical section (9) in the general shape of a straight open U/channel bar, facing one another and between which identical rungs (4,8) are fixed by a pivoting axis (38); these rungs have a section (16) in the general shape of an open U/channel bar, with dimensions which are less than the section of the uprights; at least one of the parts comprises a device (34) for holding the ladder open, a fixed device which is placed below a rung (4,8) when the ladder is closed; section (9) of the uprights comprising, on the lateral side forming the base, a guide groove (13) in the general shape of a T and into which is slipped, in the two uprights of one part of the ladder, the head (21) of a flat interlocking piece (20), in the general shape of a T, of the two parts (1,5) of the ladder; the interlocking piece (20) is fixed in a limited pivoting position close to the upper end of the two other uprights of the other part of the ladder so that one of the two parts of the ladder may be simultaneously slid parallel to the other and/or pivoted with respect to the other; uprights of one part of the ladder into which are fixed, parallel to the central part, at least one plate (29) termintating in a nose section (29*a*) in the shape of a hook, emerging from these uprights, a hook part which is placed in a series of slots (31) provided at various eye-level heights in the uprights of the other part of the uprights of the ladder, hooks for holding one part of the ladder with respect to the other when it is being used as a flat extendible ladder.

2. A double ladder in accordance with claim 1, characterized in that its uprights are extended metal sections (9) identical to one another in the shape of a straight U/channel bar, of which the external face (10*a*) of the central part is straight and forms the external face of each upright; one of the external lateral sides (11) is straight and forms the free side of the uprights and the other side (12) which serves as a base is equipped with the guide groove (13) with the general shape of a T; sections which comprise internally two supporting wings (14,15) parallel to the central part (10); and that its rungs (4, 8) are extruded metallic sections identical to one another in the shape of an open U/channel bar, of which at least one external face 17*a* of the central part (17) is convex and contains adhesion grooves, whilst the lateral parts (18, 19) are straight.

3. Double ladder in accordance with claim 2, characterized in that the interlocking piece (20) is an elongated piece, which is flat with the exception of its head (21), in the shape of a T, of a size corresponding with the guide groove (13) of the uprights of one part of the ladder into which the head is slid; an interlocking piece which comprises an opening (22) for the passage of a pivoting axis (27) which screws it down in the uprights of the other part of the ladder; a piece which is cut on a face to present three support faces (23, 24, 25) limiting its pivoting, so that, when it is inserted through a slot (28) of sufficient length, provided in the groove (13) of the upright of this second part of the ladder, the interlocking piece rests by one support face (24) or by the other two (23, 25) support faces in these uprights.

4. Double ladder in accordance with claim 3, characterized in that the plates (29) terminating in a nose piece (29*a*), in the shape of a hook, comprise a straight notch (29*b*) turned downwards, the width of which is slightly greater than the side of a section (9) used as an upright; and that these plates are fixed by passing through a slot (30) provided along the bottom of the guide groove (13) of the uprights of the part of the ladder into which is slid the head of the interlocking piece; and that the nose piece (29*a*), in the shape of a hook, emerging from this part of the ladder may be set into a certain number of slots (31) provided at specific distances along the bottom of the guide groove (13) of the uprights of the other part of the ladder; the height of these slots is sufficient to allow the nose of these plates first of all to be raised and then to be taken out.

5. Double ladder in accordance with claim 1, characterized in that the two uprights (6, 7) of the part (5) of the double ladder in which interlocking pieces (20) are fixed, in a free pivoting position, comprise lower separable upright lengths (6*a*, 7*a*) obtained by separating horizontally the lengths outside the uprights below the last rung (8); the ends opposite the two parts of the uprights are partially cut in a bevelled fashion to present a partially sloping face; the two parts of the uprights being linked by section lengths (41, 41*a*) in the shape of an asymmetrical portico, of which the central part (42) rests and is fixed in the upright parts against the internal central face (40), and the two perpendicular wings (43, 44) provided asymmetrically in relation to the central part (42) so that, two sections are reversed in relation to one another, the wings of one are situated on another plane parallel to that of the wings of the other so that, these section lengths being equally cut in a bevelled fashion like the uprights, with the exception of a part of their wings which is extended, these wings face one another so as to allow the insertion of a pivoting axis (45).

6. Double ladder in accordance with claim 5, characterized in that the lengths of the lower uprights (6*a*, 7*a*), which are separable, are clamped in a separated position or in a position with the uprights extended, by a ball clamp equipped with a pressure spring which can place itself partially in a first cavity (46) and a second cavity (47) successively of a section wing in the shape of a portico.

7. Double ladder in accordance with claim 5, characterized in that the lengths of the separable lower uprights (6*a*, 7*a*) are clamped in a separated position or in a position with the uprights extended, by a sector comprising a curved spring sheet which can place itself partially in a first cavity (46) and a second cavity (47) successively of a section wing in the shape of a portico.

8. Double ladder in accordance with claim 1, characterized in that a plate (34) is provided for holding the ladder open comprises a fixed device placed under a rung (4,8) when the ladder is closed and consists of a plate held in a free pivoting position below a rung of the part of the ladder to which the interlocking pieces (20) are fixed, the rung being at a height which is easily reached by hand; a plate which comprises a slit (34*a*) forming a holding notch and terminates in a pointed, triangular part (34*b*): the purpose of this holding notch (34*a*) is to clamp the plate on a fixed axis (36) when the ladder is open; this fixed axis (36) is held by the lateral sides of an upright, the length of the plate being such that is triangular part (34*b*) has to be on the other side of the fixed axis (36) even when the ladder is closed, so as to force the end of the plate to pass through an opening (37) provided to the central part (10) of an upright when the ladder is open; this part emerges from the upright and can be lifted in order to release the holding notch of the plate from the fixed axis so as to be able to close the ladder again.

9. Double ladder in accordance with claim 8, characterized in that said plate (34) is held on one side by the fixed axis (36) and when the ladder is closed, on the other side, by the pivoting axis (38) of the upright of the rung (4,8) surmounting the one to which the plate is fixed.

10. Double ladder in accordance with claim 1 characterized in that said uprights are provided with terminal feet (48), rubber components with a convex curve towards the bottom (48*a*) and adhesion lines surmounted first of all by a part with the general internal dimensions of the section used for the uprights, then by a part (48*b*) with the general internal dimensions of this same section; a part by which the terminals are fixed by means of an axis (49) to these sections (9), a terminal part (48*b*) limited to the part on this side of the wings (14, 15) of this section (9).

11. Double ladder in accordance with claim 1, to characterized in that terminal feet (50) are provided on the separable upright lengths (6*a*, 7*a*) and have a double bearing (50*a*, 50*b*) towards the bottom, also being partially cut in a bevelled fashion in the same way as these lengths.

12. Double ladder in accordance with claim 11 characterized in that the terminal feet (50) are provided with a tongue (50*d*) placed behind the wings (14, 15) of the section (9) used for the uprights.

13. Double ladder in accordance with claim 12, characterized in that, in a closed position, it takes on the form of a simple chest without any protrusions.

* * * * *